US005839818A

United States Patent [19]

Janson et al.

[11] Patent Number: 5,839,818

[45] Date of Patent: Nov. 24, 1998

[54] CAPPED ELECTRIC LAMP AND LIGHTING SYSTEM COMPRISING A REFLECTOR AND AN ASSOCIATED CAPPED ELECTRIC LAMP

[75] Inventors: Cornelis J. Janson, Eindhoven, Netherlands; Hans-Ulrich Rienäcker, Stolberg, Germany

[73] Assignee: U.S. Philips Corporation, New York, N.Y.

[21] Appl. No.: 718,792

[22] Filed: Sep. 24, 1996

[30] Foreign Application Priority Data

Sep. 25, 1995 [EP] European Pat. Off. ..... 95202579

[51] Int. Cl.[6] ..... H01R 33/00

[52] U.S. Cl. ..... 362/226; 362/306; 313/318.11

[58] Field of Search ..... 362/226, 306, 362/390, 440, 448; 313/318.11, 318.12, 318.01, 318.05

[56] References Cited

U.S. PATENT DOCUMENTS

| | | | |
|---|---|---|---|
| 4,403,276 | 9/1983 | Blaisdell | 362/226 |
| 4,513,356 | 4/1985 | Mikola | 313/318.11 |
| 4,622,486 | 11/1986 | Endo | 313/318.11 |
| 4,816,977 | 3/1989 | Sorensen | 362/448 |
| 4,943,898 | 7/1990 | Weenink | 362/226 |
| 5,115,381 | 5/1992 | Van Hesswijk | 362/61 |
| 5,216,319 | 6/1993 | Van Heeswijk | 313/318.09 |
| 5,378,958 | 1/1995 | Van Heeswijk | 313/318.03 |
| 5,412,275 | 5/1995 | Dorsemagen et al. | 313/318.01 |
| 5,461,277 | 10/1995 | Van Gennip et al. | 313/331 |
| 5,479,066 | 12/1995 | Willems et al. | 313/318.05 |
| 5,497,049 | 3/1996 | Fischer | 313/634 |
| 5,513,082 | 4/1996 | Asano | 362/226 |
| 5,527,199 | 6/1996 | Feder et al. | 445/49 |
| 5,541,471 | 7/1996 | Terheijden et al. | 313/112 |
| 5,619,102 | 4/1997 | Scholler | 313/635 |
| 5,646,471 | 7/1997 | Scholler et al. | 313/25 |
| 5,677,589 | 10/1997 | Westemeyer | 313/25 |
| 5,736,811 | 4/1998 | Westemeyer et al. | 313/318.02 |
| 5,742,114 | 4/1998 | Kohl et al. | 313/318.01 |

*Primary Examiner*—Alan Cariaso
*Attorney, Agent, or Firm*—F. Brice Faller

[57] ABSTRACT

The cap (10) of the capped electric lamp (1) has a resilient member (14) which acts transversely to the axis (10') of the cap. This allows the lamp to be used in a lighting system having the lamp and a reflector (40), in which the reflector is of a simple construction. The resilient member (14) presses transverse reference locations (13) of the cap against flat mounting surfaces (50) in the reflector, which are located on the legs of a V. The cap (10), and thus the electric element (3) inside the lamp vessel (2), are as a result accurately positioned in the reflector in two directions transverse to the axis. The cap (10) may in addition have projections (23,24, 25) distributed over its circumference, each having an axial reference location (12), by which the cap is axially aligned in the reflector (40) through cooperation with surfaces (49) ridge portions (46,47,48) of the reflector.

17 Claims, 3 Drawing Sheets

CAPPED ELECTRIC LAMP AND LIGHTING SYSTEM COMPRISING A REFLECTOR AND AN ASSOCIATED CAPPED ELECTRIC LAMP

BACKGROUND OF THE INVENTION

The invention relates to a capped electric lamp comprising:

a light-transmitting lamp vessel which is closed in a vacuumtight manner;

an electric element accommodated in the lamp vessel;

current conductors electrically connected to the electric element and issuing from the lamp vessel to the exterior;

a lamp cap having an axis and contacts and securely fastened to the lamp vessel, which contacts are electrically connected to the current conductors, which lamp cap has first circumferentially distributed reference surfaces facing in a direction parallel to the axis and second reference facing the axis on one side thereof, while the electric element occupies a predetermined axial position relative to the first reference surfaces and a predetermined position in directions transverse to the axis relative to the second reference surfaces.

The invention also relates to a lighting system with a reflector and an associated capped electric lamp.

Such an electric lamp and a lighting system with the lamp are known from U.S. Pat. No. 5,115,381.

The known lamp has first reference surfaces in the form of stamped elevations in a metal positioning member of the lamp cap, which elevations bear on an outer surface at the rear of a reflector when the lamp is mounted in this reflector. The positioning member furthermore has circumference portions which lie on a circle as its second reference surfaces.

The known reflector has two support surfaces, lying on the legs of a V and axially directed, for the second reference surfaces of the positioning member, and opposite thereto a pressure member acting transversely to the axis towards the V so as to press the reference surfaces against the support surfaces. As a result, the lamp, whose electric element is accurately positioned relative to the second reference surfaces, is accurately positioned with its electric element in two directions transverse to the axis after being mounted in the reflector. Provided the electric element is also accurately positioned relative to the first reference surfaces, this element will be accurately placed in the reflector after mounting therein if also the first reference surfaces are pressed against the rear of the reflector by another pressure member.

Lamps having a very high brightness when their electric elements are operating are increasingly used in reflectors. Unpleasant stray light may readily be formed thereby when the lamp is incorrectly placed in a reflector. This may have serious consequences when the lamp is used as a vehicle headlamp.

It is true that electric elements can be positioned with a high degree of accuracy in a lamp vessel, but a fine tuning of the electric element relative to the lamp cap is still necessary, as is obviously an accurate placement of the lamp cap in a reflector.

A capped electric lamp is known from EP-A-0 618 609 (U.S. Pat. No. 5,479,066) in which a rubber disc is present in the lamp cap, pierced by the current conductors and closing around said conductors in a gastight manner.

Capped electric lamps for use in a reflector are known from U.S. Pat. No. 5,216,319 and U.S. Pat. No. 5,378,958 where the electric element is a pair of electrodes and where the lamp vessel is held by a metal sleeve which acts as a clamping member. Such capped discharge lamps are also known from U.S. Pat. No. 5,412,275, EP-A-0 570 068 (U.S. Pat. No. 5,736,811), EP-A-0 576 071 (U.S. Pat. No. 5,497,049), EP-A-0 581 354 (U.S. Pat. No. 5,461,277), EP-A-0 579 313 (U.S. Pat. No. 5,527,199) and EP-A-0 658 920 (U.S. Pat. No. 5,541,471). Such capped discharge lamps are also described in the Applications of earlier date EP 94 20 13 18.6 (U.S. Pat. No. 5,646,471), EP 94 20 14 16.8 (U.S. Pat. No. 5,677,589), EP 94 20 32 76.4 (U.S. Pat. No. 5,619,102), EP 94 20 37 50.8 (U.S. Pat. No. 5,654,608), EP 95 20 11 07.0 and EP 95 20 11 50.0 (U.S. Pat. No. 5,742,114).

It is a disadvantage of the lamp described in U.S. Pat. No. 5,115,381 that a transversely acting pressure member is necessary as part of the reflector for pressing the second reference surfaces in the reflector transversely to the axis. This pressure member renders the reflector construction more complicated and is disadvantageous for the reliability of an accurate placement of the lamp, especially so after several lamps have been inserted in a reflector several times already.

SUMMARY OF THE INVENTION

It is an object of the invention to provide a capped electric lamp which renders it unnecessary to fit a reflector with a transversely acting pressure member for an accurate transverse placement of the lamp.

According to the invention, the lamp cap has a resilient member fixed thereto which acts transversely to the axis and is arranged at a surface of the lamp cap opposite the second reference surfaces.

The lamp according to the invention has its own, built-in means for positioning it accurately in transverse direction in a reflector. When a spent lamp is replaced with a new one, the latter brings its own fresh means, i.e. the resilient member. Another advantage is that the lamp is pressed home in a jig for aligning the electric element during lamp manufacture in the same manner and by the same resilient member as during its subsequent mounting in a reflector.

The resilient member may be made, for example, from synthetic resin and may be, for example, integral with a portion of the lamp cap. It is favorable, however, when the resilient member is made of metal when lamp operation takes place at comparatively high temperatures. The member may be, for example, a metal helix, but in a favorable embodiment it is made from sheet metal.

The resilient member may be connected to the lamp cap, for example to a metal coupling member of the lamp cap which holds the lamp vessel in position relative to the lamp cap. Such a coupling member may connect the lamp vessel to, for example, a synthetic resin housing of the lamp cap. It is favorable because of the reduced amount of assembling work when the resilient member is integral with the coupling member.

Preferably, the coupling member is a substantially cylindrical body which is fixed in a cavity of a housing, for example made of synthetic resin, and which projects therefrom to the exterior. The coupling member may, for example, have openings and be heated together with the housing, for example ultrasonically, whereby material of the housing is forced through the openings and a coupling is achieved. The coupling member may alternatively have been present in the mould during the formation of the housing and thus have become integral with the housing, or enclosed between two parts from which the housing may be built up. It is also possible for ridges to be present in the cavity of the housing and for the coupling member to have recesses with barbed hooks by which the coupling member has fixed itself around the ridges.

It is favorable when the lamp vessel is held clamped by a clamping member which cooperates with the coupling member, for example telescopically, and which is fastened thereto, for example welded thereto. The clamping member may be a metal plate with a cylindrically flanged rim which has an opening along which resilient tabs are arranged. The lamp vessel in that case projects through the opening and is securely held by the tabs. Alternatively, the clamping member may be, for example, a metal sleeve around the lamp vessel.

Before being fastened to the coupling member, the clamping member may be rotated, tilted and/or translated in/around the coupling member so as to bring the electric element into the desired aligned position relative to the reference locations.

The resilient member of the lamp cap of the lamp is also useful in a lighting system, where it suffices to position the lamp in directions transverse to the reflector axis in that a lamp cap, for example cylindrical in shape, is diametrically pressed home in an opening, for example a cylindrical opening, in a reflector. The two reference surfaces may then coincide or substantially coincide.

In a special embodiment, the lamp cap is provided not only with a resilient member for pressing the second reference locations against their support locations of the reflector, but also with means for fixing itself in the reflector. This embodiment renders a further simplification of the reflector construction possible.

It is favorable for this purpose when a circumferential projecting collar is present at the housing of the lamp cap, and when projections are present at a distance therefrom, closer to the lamp vessel, distributed over a circumference of the housing.

In a modification thereof, the lamp itself includes the means for pulling the first reference locations axially against abutments of the reflector. In that case, the projections have at a surface facing the collar as the first reference location a guiding surface approaching the collar.

It is favorable when the projecting collar has a seat in which a sealing ring is accommodated. A vaporproof connection between the lamp cap and the reflector can be realized thereby. A rigid axial coupling between the lamp cap and the reflector is also obtained then. Such a rigid coupling, however, may alternatively be obtained without such a ring by means of the elasticity of the collar, but the ring, for example a flat ring or an O-ring, provides a higher security as to vaporproofness of the connection.

It is noted that an elastic ring arranged between the reflector and the lamp cap in axial direction generally leads to an inaccuracy in the axial location of the electric element of the lamp in the reflector, because the ring is more or less strongly compressed. In the lamp according to the invention, however, it is the surfaces facing the collar which are reference locations. These are in contact with the reflector, and accordingly the lamp is correctly located axially.

This embodiment has the advantage for the reflector that all parts important for the correct placement of the lamp and all surfaces and shapes important for the correct reflection of the light generated by the lamp are determined by one mould part, i.e. that part which shapes the concave reflecting surface. The second mould part only determines the outer shape of the reflector, which is of no or little critical importance.

In a favorable embodiment, the resilient member is arranged between a projection and the collar. Its location between the projection and the collar gives the resilient member a protection against damage. The resilient member may extend axially into the projection or through the projection. The member in that case has a comparatively high rigidity owing to its comparatively great axial dimension.

The housing of the lamp cap may have surfaces lying on the shell of one and the same cylinder between two remaining projections and the collar by way of second reference locations. The resilient member and the second reference locations have then a favorable position in one transverse plane.

The lamp vessel may be made of glass, for example hard glass or quartz glass, or from a ceramic material, for example monocrystalline sapphire or polycrystalline sintered alumina. The electric element may be a pair of electrodes in an ionizable medium or an incandescent body, for example in a gas comprising a halogen. The electric element may be positioned transverse to the axis, but in a favorable embodiment it is axially directed.

The housing of a synthetic-resin lamp cap may be made, for example, from a thermoplastic material, for example polyether imide or polyphenylene sulphide if the housing is exposed to high thermal loads, but alternatively, for example, polybutylene terephthalate.

The housing may be sealed around the current conductors, for example with cement or in that the housing was fused at the lead-through areas of the current conductors. It is alternatively possible to construct the housing from a first part facing towards the lamp vessel and, for example, made from a synthetic resin resistant to high temperatures, and a second part facing away from the lamp vessel, for example made from a synthetic resin resistant to lower temperatures, which parts are joined together with the interposition of a body, for example a rubber-type body, for example a disc which is pierced by the current conductors when the lamp vessel is mounted in the lamp cap.

The lighting system according to the invention includes a reflector and an associated capped electric lamp, which reflector has a concave reflecting surface with an optical main axis and on this axis a light emission window and opposite thereto, adjacent its apex, an opening in which the lamp cap of the electric lamp is to be fixed such that the electric element thereof is positioned in a predetermined location in the reflector.

The opening is bounded by a circumferential ridge with interruptions which define a first, a second, and a third ridge portion, which ridge portions each have a first surface facing the light emission window and a second surface facing the optical main axis.

The second surfaces of the first and of the second ridge portion each comprising a substantially plane surface which is situated on a respective leg of a V, and the second surface of the third ridge portion has a substantially cylindrical surface which faces towards the plane surfaces of the first and of the second ridge portion.

The electric lamp is an embodiment of the lamp described above with outward projections at its lamp cap.

The light emission window of the reflector may be closed off with a plate, for example with a lens. The reflector may be, for example, of paraboloidal or ellipsoidal shape, or of the complex shape type, and may be used together with the lamp according to the invention, for example, in a vehicle headlight.

The lamp is inserted into the reflector from the rear in a simple translation, during which the projections of the lamp cap each pass between two respective ridge portions, which is then followed by a rotation. The geometry of the projections and of the ridge portions may render it possible for the coupling to be achievable in one rotational position only. This geometry may in addition be used for allowing the placement of exclusively a lamp for which the reflector was designed.

The lamp has the advantage that it can be inserted into the reflector through translation without any appreciable friction having to be overcome. It is not until the rotation is started, during which the lamp has been substantially positioned in axial direction, that a substantial friction is to be overcome because the resilient member comes under compression owing to its contact with the second surface of the third ridge portion.

It is favorable when the lamp and the reflector have a palpable criterion indicating that the correct rotational position of the lamp has been reached. The reflector may comprise for this purpose a substantially axially directed abutment surface for the lamp cap of the electric lamp. This abutment surface may be formed by a projection on a ridge portion, for example a projection entering the reflector axially from the third ridge portion.

In a favorable embodiment, the reflector has means for locking the electric lamp in its predetermined position. For this purpose, the reflector may have an elevation at a distance from the projection, for example on the second surface of the third ridge portion. During lamp rotation, the elevation must first be overcome, during which the resilient member is additionally compressed, before said member enters its end position in a less compressed state. This counteracts the effect that vibrations can move the lamp from its operational position.

The first, second, and third ridge portions may each have a guiding surface provided on their first surface and obliquely approaching said first surface so as to facilitate the rotation of a lamp cap, for example, if the projections of the lamp cap do not have guiding surfaces.

BRIEF DESCRIPTION OF THE DRAWINGS

Embodiments of the capped electric lamp and of the lighting system according to the invention are shown in the drawing, in which.

DESCRIPTION OF THE PREFERRED EMBODIMENTS

Figure 1:
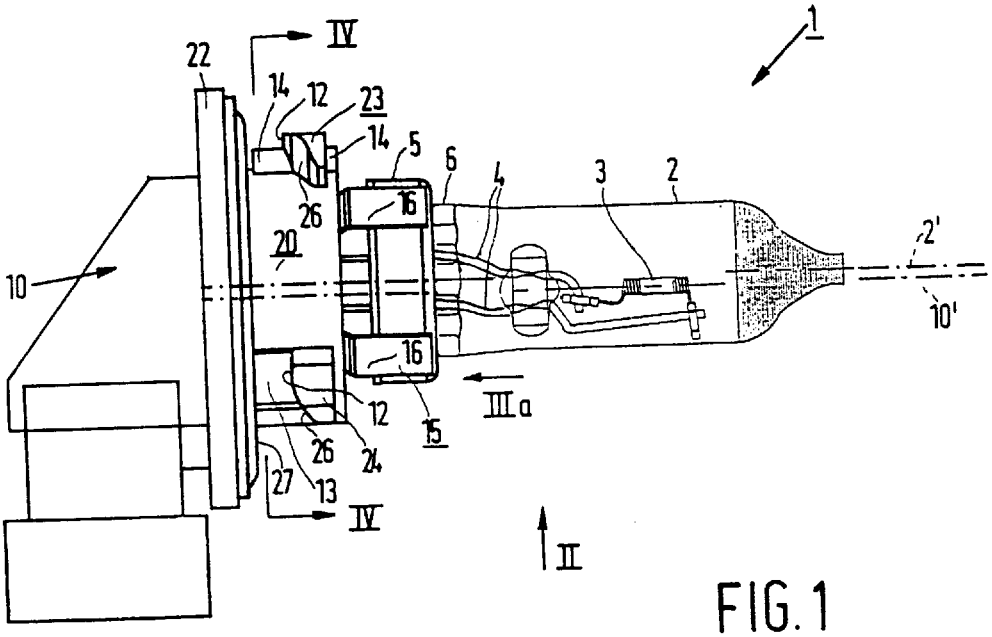
FIG. 1 shows the lamp in side elevation.
Figure 2:
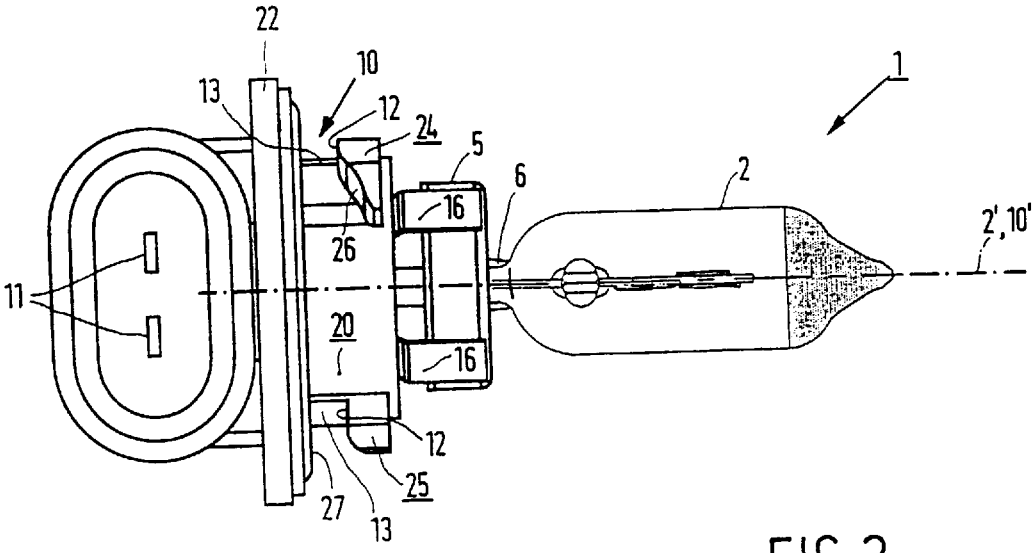
FIG. 2 shows the lamp taken on the line II in FIG. 1.

In FIG. 1, and also in FIG. 2, the capped electric lamp 1 has a light-transmitting lamp vessel 2, made of quartz glass in the Figure and closed in a vacuumtight manner. An electric element 3, an incandescent body in the Figure, is accommodated in the lamp vessel. Current conductors 4 electrically connected to the electric element 3 issue from the lamp vessel 2 to the exterior. A lamp cap 10 with an axis 10' and contacts 11 is securely fastened to the lamp vessel. The contacts are electrically connected to the current conductors. The incandescent body is arranged on the axis 10' of the lamp cap and parallel to the axis 2' of the lamp vessel. Undesirable reflections are counteracted by the fact that the incandescent body is arranged eccentrically in the lamp vessel.

The lamp cap 10 has first reference locations 12 distributed over a circumference and second reference locations 13 situated close together. The electric element 3 occupies a predetermined axial position relative to the first reference locations 12 and a predetermined position in directions transverse to the axis 10' relative to the second reference locations 13. The lamp shown has a right-angled lamp cap whose contacts 11 are directed transversely to the axis 10', but in an alternative embodiment the lamp cap is linear and the contacts extend along the axis.

The lamp vessel of the lamp shown has a filling of xenon with a pressure of approximately 15 bar at room temperature and comprising a halogen, for example hydrogen bromide. The incandescent body has a temperature of approximately 3100° C. during operation. The incandescent body as a result has a high brightness. Thanks to the high filling pressure, the lamp has a life of approximately 800 hours. The lamp consumes a power of approximately 35 W.

The lamp cap 10, at a surface thereof, has a resilient member 14 arranged opposite the second reference locations 13 and acting transversely to the axis 10'. The resilient member 14 is made from sheet metal in the Figure.

The lamp vessel 1 is held clamped by a clamping member 5 of metal plating with a cylindrically flanged rim which clamps with resilient tabs 16 around the pinch seal 6.

Figure 3A:
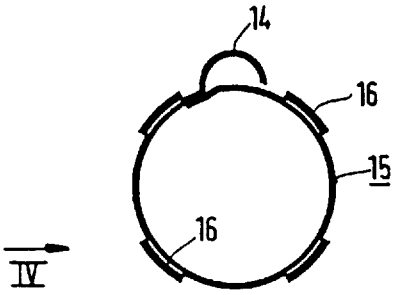
FIG. 3*a* shows the coupling member taken on the line IIIa in FIG. 1.
Figure 4:
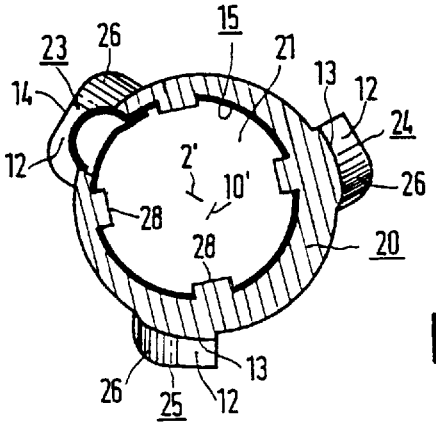
FIG. 4 is a cross-section through the lamp cap taken on the line IV in FIG. 1, rotated counterclockwise through approximately 60°.

A coupling member 15, see also FIG. 4, is fixed in a cavity 21 of a synthetic-resin housing 20 of the lamp cap, from which it projects to the exterior. It is a substantially cylindrical body, see also FIGS. 3*a* and 4. The clamping member 5 cooperates telescopically with the coupling member 15 and is fastened thereto, in FIG. 1 by means of welded joints on the tabs 16 after the incandescent body had been brought into a predetermined position relative to the reference locations.

Figure 3B:
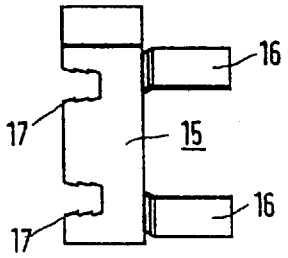
FIG. 3*b* shows the coupling member taken on the line IIIb in FIG. 3*a;*

The resilient member 14, see FIGS. 3*a*, 3*b*, 4, is connected to the metal coupling member 15 and is integral therewith in the drawings. The coupling member is made of stainless-steel sheet in the drawings. It has serrated recesses 17 by means of which it is fixed over projections 28 in the housing 20 of the lamp cap, see FIG. 4. It was formed by cutting from metal strip, bending, and welding. The resilient member here has a substantially semicylindrical shape with an axially extending integral connection to the coupling member at one side. Opposite this connection, the resilient member 14 in the embodiment shown has a space up to the coupling member 15 so as to achieve a spring force suitable for the embodiment.

A circumferential projecting collar 22 is present at the housing 20 of the lamp cap 10. At a distance thereof, closer to the lamp vessel 1, projections 23, 24, 25 each have a guiding surface 26 approaching the collar at a surface facing towards the collar and acting as the first reference locations 12.

The resilient member 14, see FIG. 1, is arranged between a projection 23 and the collar 22 and extends axially into the projection 23 in the Figure, and even through this projection. It projects to the exterior through an opening in the wall of the housing 20, see FIG. 4. The projection 23 bridges this opening over an axial portion thereof, thus giving the housing an enhanced dimensional stability. It is apparent from FIG. 4 that the coupling member 15 is accommodated eccentrically in the lamp cap 10, so that the incandescent body present eccentrically in the lamp vessel can be positioned centrically relative to the lamp cap.

The housing 20 of the lamp cap 10 has surfaces lying on the shell of one and the same cylinder as the second reference locations 13 at least between two remaining projections 24, 25 and the collar 22.

The projecting collar 22 has a seat in which a sealing ring 27 is accommodated.

Figure 5:
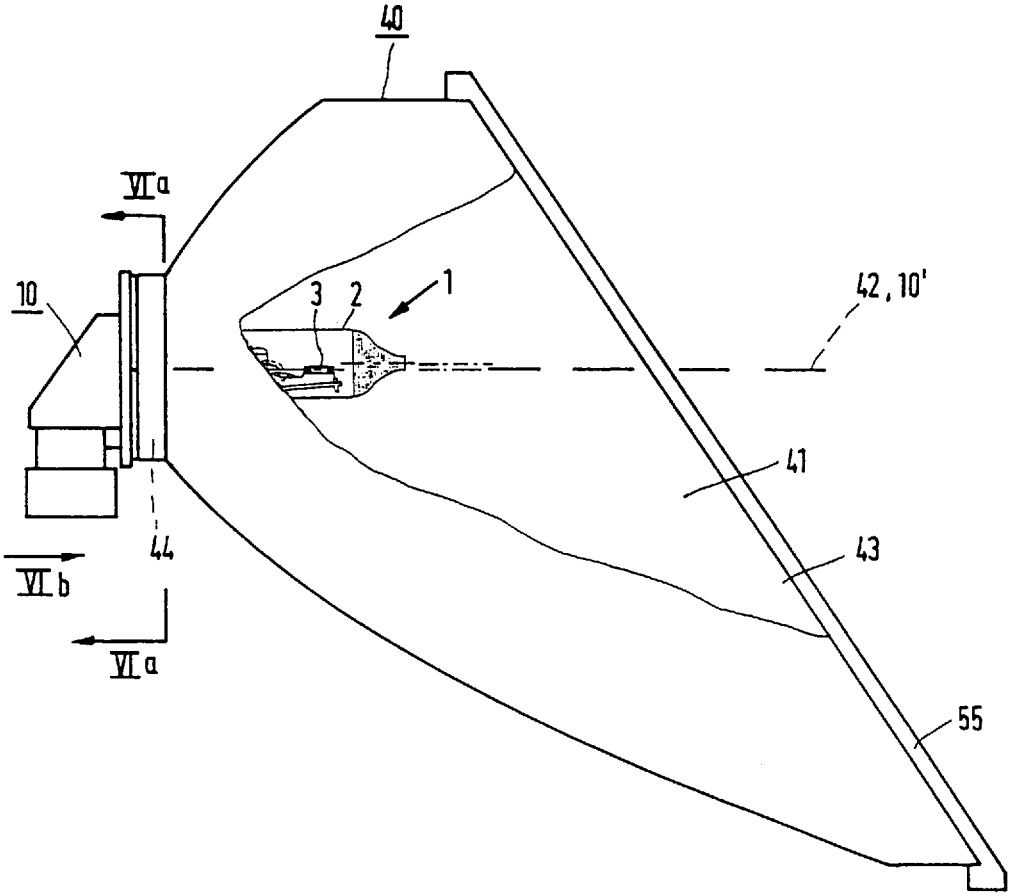
FIG. 5 shows the lighting system in side elevation, partly broken away.

The reflector 40 of FIG. 5 in the lighting system with the reflector and the associated capped electric lamp has a concave reflecting surface 41 with an optical main axis 42, and on this axis a light emission window 43 and arranged oppositely, near its apex, an opening 44 in which the lamp cap 10 of the electric lamp is to be fixed, so that the electric element 3 thereof is positioned in a predetermined location in the reflector 40. The reflector shown is of the complex shape type with surfaces of different curvature above the optical main axis and below this axis. The reflector is closed with a lens 55.

Figure 6A:
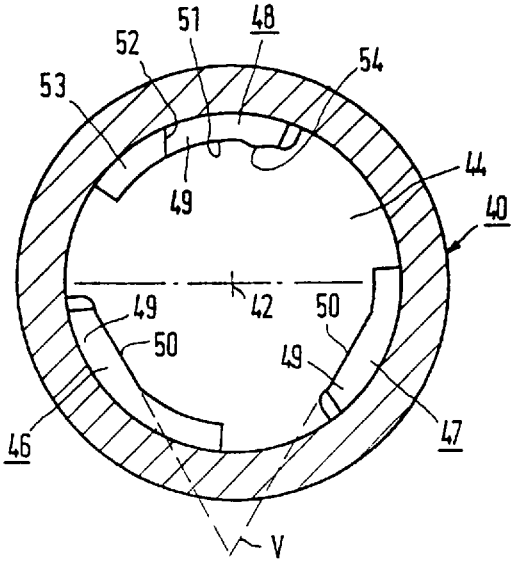
FIG. 6*a* is a cross-section taken on the line VIa in FIG. 5.
Figure 6B:
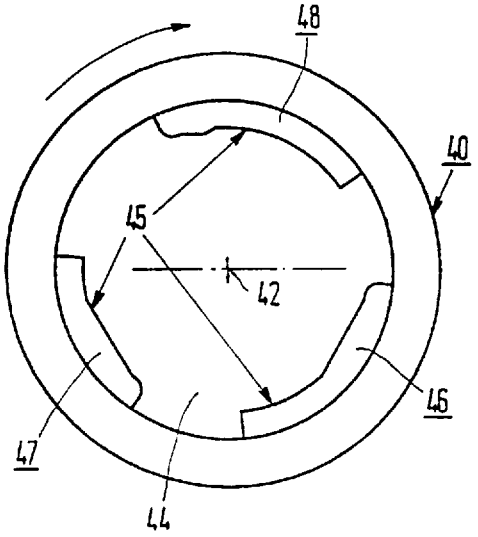
FIG. 6*b* is an elevation of the opening in the reflector viewed along VIb in FIG. 5.

The opening 44, see FIGS. 6*a* and 6*b*, is bounded by a first 46, a second 47, and a third ridge portion 48 separated by interruptions 46', 47', and 48'. The ridge portions 46, 47, 48 each have a first surface 49 facing the light emission window 43 and a second surface 50, 51 facing the optical main axis 42.

The second surfaces 50 of the first 46 and the second ridge portion 47 each comprise a substantially planar surface situated on a respective leg of a V.

The second surface 51 of the third ridge portion 48 comprises a substantially cylindrical surface facing towards the plane surfaces of the first 46 and the second ridge portion 47.

The electric lamp 1 of FIGS. 1 and 2 is accommodated in the reflector. The axis 10' of the lamp cap 10 then coincides with the optical main axis 42.

The reflector 40 has a substantially axially directed abutment surface 52 for the lamp cap 10 of the electric lamp 1. The abutment surface 52 is formed by a projection 53 on at least one of the ridge portions 46, 47, 48, here on the third ridge portion 48. The projection 53 in FIG. 6*a* projects axially inwards into the reflector 40 from there.

The reflector 40 has an elevation 54 on the second surface 51 of the third ridge portion 48, at a distance from the projection 53, as means for locking the electric lamp 1 in its predetermined position.

In FIG. 4, the lamp cap is depicted in the rotational position in which it can be introduced into the opening 44 in FIG. 6*b* by a translatory movement in FIG. 6*b* in FIG. 6*b*. Then the lamp cap is rotated along the arrow through an angle of approximately 60°. The guiding surfaces 26 on the projections 23, 24, 25 of the lamp cap bring the first or axial reference locations 12 into contact with the first surfaces 49 of the ridge portions 46, 47, 48, whereby the lamp cap is positioned in axial direction. In spite of these guiding surfaces, or in the absence of these guiding surfaces, the ridge portions may also have such guiding surfaces.

The resilient member 14 is compression-loaded when the rotation is started, first to an increasing degree by the elevation 54 and subsequently to a decreasing degree by the second surface 51 of the third ridge portion 48. As a result, the resilient member presses the lamp cap with the second or transverse reference locations 13 thereof against the second surfaces 50 of the first and the second ridge portions 46, 47 situated on the legs of a V, so that the lamp cap is accurately positioned in directions transverse to the axis 42. Since the incandescent body has been positioned relative to the lamp cap, the incandescent body is now positioned relative to the reflector.

In FIGS. 6*a* and 6*b*, the ridge portions 46, 47 also comprise portions with cylindrical surfaces facing towards the axis 42. The interruptions 46', 47', 48' are configured so the lamp can be inserted in one rotational orientation only, the projections, 23, 24, 25 being received only in respective interruptions 48', 46', 47'.

The lighting system may be used as a vehicle headlight.

We claim:

1. A capped electric lamp comprising:

a light-transmitting lamp vessel which is closed in a vacuumtight manner;

an electric element accommodated in the lamp vessel;

current conductors electrically connected to the electric element and issuing from the lamp vessel to the exterior;

a lamp cap having an axis and contacts and securely fastened to the lamp vessel, said contacts being electrically connected to the current conductors, said lamp cap having first circumferentially distributed reference surfaces facing in a direction parallel to the axis and second reference surfaces facing the axis on one side thereof, while the electric element occupies a predetermined axial position relative to the first reference surfaces and a predetermined position in directions transverse to the axis relative to the second reference surfaces, the lamp cap having fixed thereto a resilient member which acts transversely to the axis opposite the second reference surfaces.

2. A capped electric lamp as claimed in claim 1, wherein the resilient member is made from sheet metal.

3. A capped electric lamp as claimed in claim 2, wherein the lamp cap comprises a synthetic resin housing and a metal coupling member fixed thereto which holds the lamp vessel in position relative to the synthetic-resin housing.

4. A capped electric lamp as claimed in claim 3, wherein the resilient member is integral with the coupling member.

5. A capped electric lamp as claimed in claim 4, wherein the coupling member comprises a cylindrical body which is fixed in a cavity of the synthetic-resin housing.

6. A capped electric lamp as claimed in claim 5, further comprising a clamping member which holds the lamp vessel and which cooperates telescopically with the coupling member.

7. A capped electric lamp as claimed in claim 3, wherein the housing further comprises a circumferential projecting collar, and projections at a distance therefrom, closer to the lamp vessel and distributed circumferentially over the housing.

8. A capped electric lamp as claimed in claim 7, wherein the projections each have a guiding surface approaching the collar, said first reference surfaces being formed on said projections and facing the collar.

9. A capped electric lamp as claimed in claim 7, wherein the resilient member is arranged between one of said projections and the collar.

10. A capped electric lamp as claimed in claim 9, wherein the resilient member extends axially into said one of said projections.

11. A capped electric lamp as claimed in claim 7, wherein the projecting collar has a seat in which a sealing ring is accommodated.

12. A capped electric lamp, as claimed in claim 7 in combination with a reflector, said reflector comprising a concave reflecting surface with an optical main axis and on this axis a light emission window, and opposite thereto, adjacent its apex, an opening in which the lamp cap is fixed such that the electric element is positioned in a predetermined location in the reflector, wherein said opening is bounded by a first ridge portion, a second ridge portion, and a third ridge portion separated by interruptions, which ridge portions each have a first surface facing the light emission window and a second surface facing the optical main axis, the second surfaces of the first and of the second ridge portion (47) each comprising a substantially planar support surface, the second surface of the third ridge portion comprising a an arcuate surface which faces towards the planar support surfaces.

13. A combination as claimed in claim 12, wherein the reflector has a substantially axially directed abutment surface for the lamp cap of the electric lamp (1).

14. A combination as claimed in claim 13, wherein the abutment surface is formed by a projection on one of said ridge portions.

15. A combination as claimed in claim 14, wherein the projection projects axially into the reflector from the third ridge portion.

16. A combination as claimed in claim 12, wherein the reflector has means for locking the electric lamp in its predetermined position.

17. A combination as claimed in claim 15, wherein the third ridge portion on the second surface has an elevation at a distance from said abutment surface as said means for locking the electric lamp.

* * * * *